US006220853B1

(12) United States Patent
Luo

(10) Patent No.: US 6,220,853 B1
(45) Date of Patent: Apr. 24, 2001

(54) DISPOSABLE CHILDPROOF LIGHTER

(76) Inventor: Ying Wen Luo, Rm. 1510 Nan Fung Centre, 264-298 Castle Peak Road, Tsuen Wan, N.T., Hong Kong (CN)

( * ) Notice: Subject to any disclaimer, the term of this patent is extended or adjusted under 35 U.S.C. 154(b) by 0 days.

(21) Appl. No.: 09/610,350

(22) Filed: Jul. 5, 2000

(51) Int. Cl.[7] ..... F23Q 2/46
(52) U.S. Cl. ..... 431/153; 431/277
(58) Field of Search ..... 431/153, 277

(56) References Cited

U.S. PATENT DOCUMENTS 5,913,674 * 6/1999 Shimizu ..... 431/153
6,074,198 * 6/2000 Rogelet ..... 431/153
6,142,768 * 11/2000 Feng et al. ..... 431/153

* cited by examiner

*Primary Examiner*—Ira S. Lazarus
*Assistant Examiner*—Sara Clarke

(74) *Attorney, Agent, or Firm*—Raymond Y. Chan; David and Raymond Patent Group

(57) ABSTRACT

A disposable childproof lighter includes an ignition means which including a flint supported by a resilient element, a striker wheel, a pair of driven gear elements each coaxially mounted on a side of the striker wheel, and a pair of driving caps each coaxially mounted between the driven gear element and the striker wheel in freely rotating manner. Each driving cap includes a driving cavity formed on an outer side thereof for receiving a gear wheel of the driven gear element in rotatable manner. A plurality of driving teeth are spacedly provided on an inner circumferential surface of the driving cavity for engaging with a plurality of driven gear teeth spacedly provided on an outer circumferential surface of the driven gear element when a downward force is applied to the two driving caps. Accordingly, children under five years old are not strong enough to press down the driving caps to generate friction between the driving caps and the driven gear elements or to maintain the engagement between the driving teeth and the driven gear teeth while turning the driving caps. However, an adult can easily "press and turn" the driving caps to finish the ignition operation.

18 Claims, 4 Drawing Sheets

DISPOSABLE CHILDPROOF LIGHTER

BACKGROUND OF THE PRESENT INVENTION

1. Field of Invention

The present invention relates to disposable lighter, and more particularly to a disposable childproof lighter wherein the driving caps are normally disengaged with the gear wheels which drive the striker wheel to ignite, so as to prevent the disposable lighter from being ignited accidentally or by children.

2. Description of Related Arts

Nowadays, both U.S. government and U.S. Consumer Product Safety Commission demand a safety device in every cigarette lighter including the disposable lighter to prevent unwanted ignition accidentally or by a child. As it is known that the disposable lighter is common and relatively cheap, it is impossible to incorporate with expensive and complex safety device that highly increases the cost of the disposable lighter. In order to minimize the manufacturing cost of the disposable lighter employed with safety device, one of the most common disposable safety lighter is the driving wheel type disposable safety lighter. This type of disposable lighter comprises a pair of driving wheels for driving the striker wheel to rotate in order to generate sparks, wherein the driving wheels normally run idle when the driving wheels are physically disengaged with the striker wheel.

For example, U.S. Pat. No. 5,547,370, owned by Hwang, discloses a wheel axle mounted between two upright supports at the top of a butane wheel, two driving wheels mounted around the wheel axle and disposed in contact with a spring-supported flint below and turned by the driving wheels through the wheel axle to strike the spring-supported flint in producing sparks. The wheel axle is made of polygonal cross section, having two round rods at two opposite ends loosely inserted into a respective axle hole on each upright support so as to ensure a better connection between the striker wheel and the wheel axle.

Another example is U.S. Pat. No. 5,997,281, owned by Lei discloses two side thumb-wheel each having a circular shallow indentation are respectively mounted on two sides of a friction thumb-wheel, wherein each circular shallow indentation has an inner diameter slightly larger that an outside diameter of the friction thumb-wheel such that the friction thumb-wheel can be inserted into the circular shallow indentation. In such arrangement, when a pressing force is applied on the two side thumb-wheels, the side thumb-wheels will engage with the friction thumb-wheel, which in turn bears against a flint to create a spark.

However, most of the driving wheel type disposable safety lighters, including the above two patents, still have the following drawbacks.

Since the dimension of the driving wheels (side thumb-wheels) are not produced precisely for minimizing the manufacturing cost of the disposable lighter, there is always a clearance between the driving wheel and the striker wheel. The clearance is supposed to provide a gap that the driving wheels can rotate loosely around the axle in such a manner the driving wheels are run idle around the axle. However, the clearance also provides a gap that the driving wheels can axially loose such that the driving wheels may not perfectly engage with the wheel axle of the striker wheel in order to provide an optimum mutual friction therebetween for ignition. Furthermore, in order to ignite the lighter, a downward force must applied on the driving wheels for engaging the striker wheel. In fact, the driving wheels are always engaged with the wheel axle of the striker wheel by gravity which acts as the downward force. In other words, the lighter, which claims as a safety lighter, may normally in a ready-to-ignite position.

SUMMARY OF THE PRESENT INVENTION

A main object of the present invention is to provide a disposable childproof lighter which prevents the lighter from being ignited accidentally or by children.

Another object of the present invention is to provide a disposable childproof lighter that the driving caps are rotatably held in a steady position so as to prevent any axially loose of the driving caps, for ensuring effective engagement of the driving cap to ignite the disposable childproof lighter.

Another object of the present invention is to provide a disposable childproof lighter wherein the driving caps are normally disengaged with the driven gear teeth, so as to prevent any unwanted ignition of the lighter.

Another object of the present invention is to provide a disposable childproof lighter, wherein in order to ignite the lighter, a user's thumb must apply a simple single operation on the driving caps, which includes a pressing down action and a rotating action at the same time. Therefore, children under five years old are unable to complete the igniting operation.

Another object of the present invention is to provide a disposable childproof lighter wherein the mechanism does not require to alter the original structural design of the disposable lighter, so as to minimize the manufacturing cost of incorporating the mechanism with every conventional disposable lighter.

Accordingly, in order to accomplish the above objects, the present invention provides a disposable childproof lighter, which comprises:

a supporting frame disposed on a gas reservoir having a valve which is actuated by a gas level pivotally mounted on the supporting frame for actuating the valve to release gas from the gas reservoir, wherein the supporting frame comprises a pair of supporting walls parallelly protruded upwardly at opposite sides of the gas level, each of the supporting walls having a supporting hole provided thereon, and an ignition means, comprising:

a flint supported by a resilient element, a striker wheel, which is rotatably mounted on the supporting frame, having a plurality of striking teeth evenly provided on an outer circumferential surface thereof, wherein the flint is supported by the resilient element to upwardly urging against a portion of the striking teeth, a pair of driven gear elements for coaxially mounting the striker wheel between the two supporting walls of the supporting frame, each of the driven gear elements comprising a gear wheel having an outer circumferential surface and a support shank integrally and coaxially protruded from an inner side of the gear wheel, wherein the two support shanks, which are smaller than the two gear wheels in diameter, are coaxially mounted on two sides of the striker wheel to define two supporting gaps between the two sides of the striker wheel and the two gear wheels respectively, and the two gear wheels are respectively and rotatably mounted to the two supporting walls of the supporting frame in such a manner that the striker wheel is capable of being driven to rotate when driving the two gear wheels to rotate, and a pair of driving caps, each having a circular driving cavity coaxially provided at an outer side thereof so as to define an inner side wall, each of the driving cavities having a diameter larger than that of the gear wheels of the driven gear elements, wherein a central support hole is coaxially provided at each of the inner side walls for rotatably mounting on the respective support shank of the respective driven gear element while the gear wheel of the respective driven gear element is rotatably received in the respective driving cavity, wherein the two inner side walls of the two driving caps are rotatably disposed in the two supporting gaps respectively so as to hold the two driving caps in a rotatable position between the striker wheel and the two driven gear elements respectively, wherein each of the driving cavities has an inner circumferential surface, wherein the two driving caps are arranged free to rotate normally with respect to the two driven gear elements unless a downward force is intentionally applied on the driving caps while rotating the driving caps to drive the driven gear elements and the striker wheel to rotate to strike against the flint to produce sparks.

DETAILED DESCRIPTION OF THE PREFERRED EMBODIMENT

Figure 1:
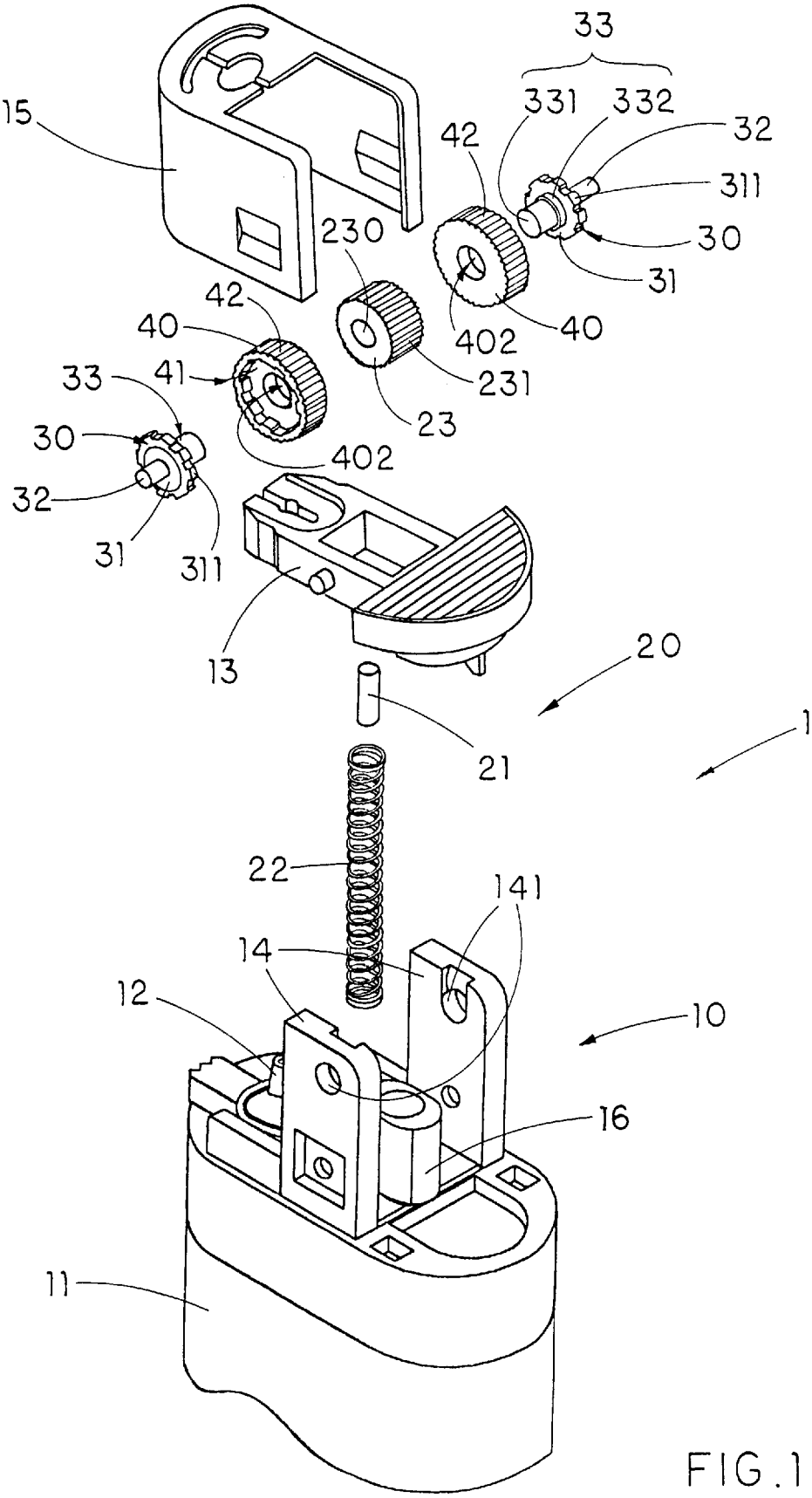
FIG. 1 is an exploded perspective view of a disposable childproof lighter according to a preferred embodiment of the present invention.

Referring to FIGS. 1 to 4 of the drawings, the disposable childproof lighter 1 according to a preferred embodiment of the present invention is illustrated, wherein the disposable childproof lighter 1 comprises a supporting frame 10 and an ignition means 20.

The supporting frame 10 is mounted on a gas reservoir 11 which has a gas valve 12 upwardly extended from the supporting frame 10. The gas valve 12 is actuated by a gas level 13 to release gas from the gas reservoir 11. The supporting frame 10 comprises a pair of supporting walls 14 parallelly protruded at opposite sides of the gas level 13 and the gas level 13 is pivotally mounted between the two supporting walls 14 of the supporting frame 10. Each of the supporting walls 14 has a supporting hole 141 provided thereon. A windshield 15 is detachably mounted on the supporting frame 10 to encircle the gas valve 12.

The ignition means 20 comprises a flint 21 supported by a resilient element 22 and a striker wheel 23. The flint 21 and the resilient element 22 are received in a flint housing 16 provided between the two supporting walls 14 of the supporting frame 10. The striker wheel 23, which is a hollow wheel body having a central axial hole 230, is rotatably mounted between the two supporting walls 14 of the supporting frame 10. An outer circumferential surface of the striker wheel 23 has a plurality of striking teeth 231 evenly provided thereon.

The flint 21 is supported by the resilient element 22 to upwardly urging against a portion of the striking teeth 231. In order to ignite the lighter 1, sparks must be produced and directed toward the gas valve 12 by driving the striking teeth 231 to strike against the flint 21.

The ignition means 20 further comprises a pair of driven gear elements 30 for coaxially mounting the striker wheel 23 between the two supporting walls 14 of the supporting frame 10. Each of the driven gear elements 30 comprises a gear wheel 31 having an outer circumferential surface 310, and a support shank 33 integrally and coaxially protruded from an inner side of the gear wheel 31. The outer circumferential surface 310 can be a coarse surface. According to the preferred embodiment, a plurality of driven gear teeth 311 spacedly provided on the outer circumferential surface 310.

Each of the support shank 33 comprises a wheel axle 331 and a support wheel 332 which is integrally and coaxially positioned between the gear wheel 31 and the wheel axle 331.

The two wheel axles 331, which are smaller than the two gear wheels 31 in diameter, are coaxially fitted into two ends of the central axial hole 230 of the striker wheel 23 respectively. Each of the two support wheels 332 has a diameter slightly larger than the two wheel axles 331, so that when the two wheel axles 331 are fully plugged into the two ends of the central axial hole 230 of the striker wheel 23, two supporting gaps 24 will be exactly defined between the two sides of the striker wheel 23 and the two gear wheels 31 respectively.

The two gear wheels 31 are respectively and rotatably mounted to the two supporting walls 14 of the supporting frame 10 in such a manner that the striker wheel is capable of being driven to rotate when driving the two gear wheels 31 to rotate. According to the preferred embodiment of the present invention, each of the driven gear elements 30 further comprises a supporting shaft 32. The two supporting shafts 32 are rotatably inserted into the supporting holes 141 of the two supporting walls 14 respectively.

Accordingly, a total thickness of the gear wheel 31 and the support wheel 332 is preferred to be equal to or slightly smaller than a distance between the respective supporting wall 14 and the opposing side of the striker wheel 23.

The ignition means 20 further comprises a pair of driving caps 40 each having a thickness equal to the total thickness of the gear wheel 31 and the support wheel 332. A circular driving cavity 41 is coaxially provided at an outer side thereof so as to define an inner side wall 401. Each of the driving cavities 41 has a diameter larger than that of the gear wheels 31 of the driven gear elements 30, wherein a central support hole 402 is coaxially provided at each of the inner side walls 401 for rotatably mounting on the support wheel 332 of the support shank 33 of the respective driven gear element 30 while the gear wheel 31 of the respective driven gear element 30 is rotatably received in the respective driving cavity 41.

Figure 2:
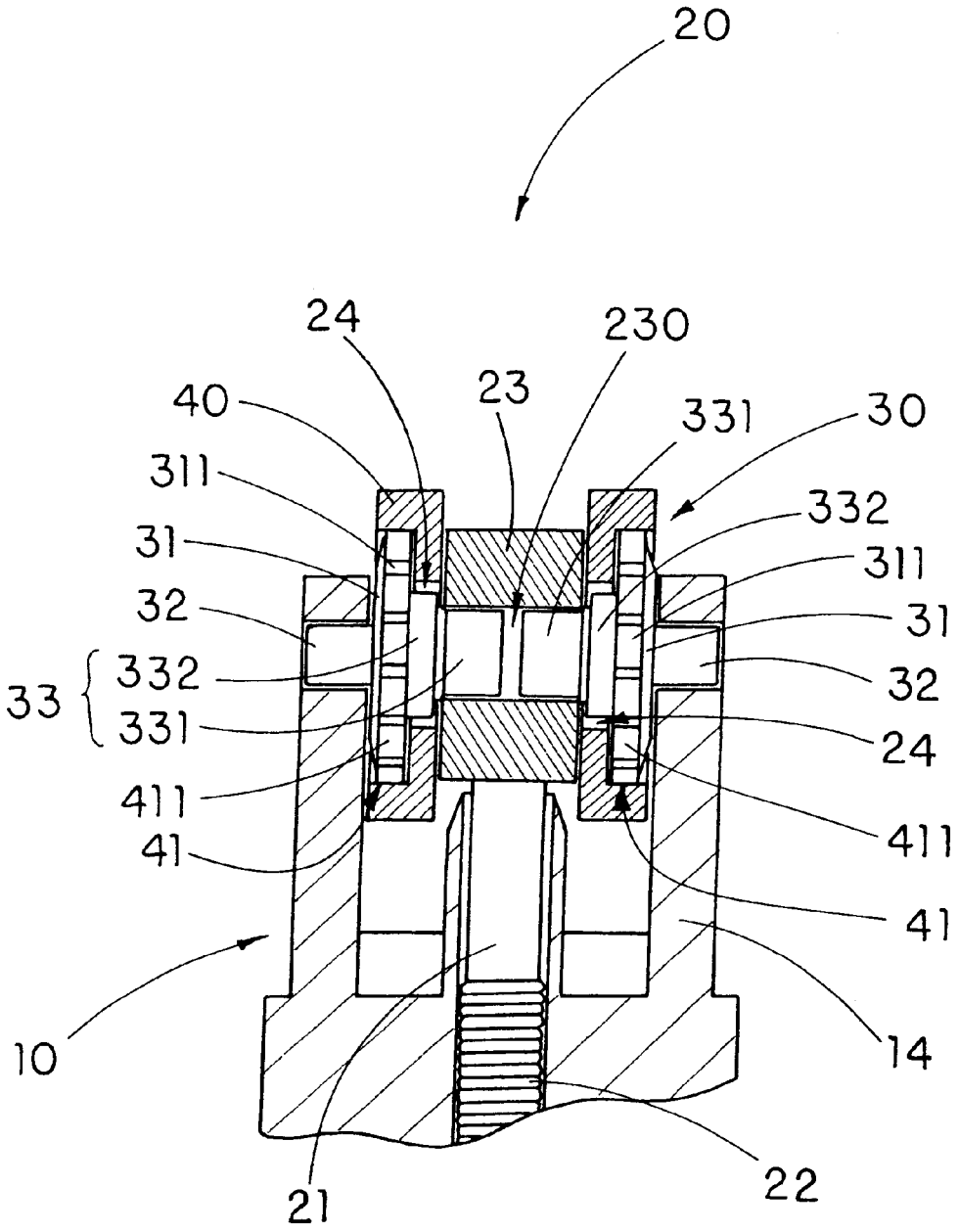
FIG. 2 is a sectional view of the ignition means of the disposable childproof lighter according to the above preferred embodiment of the present invention.
Figure 3:
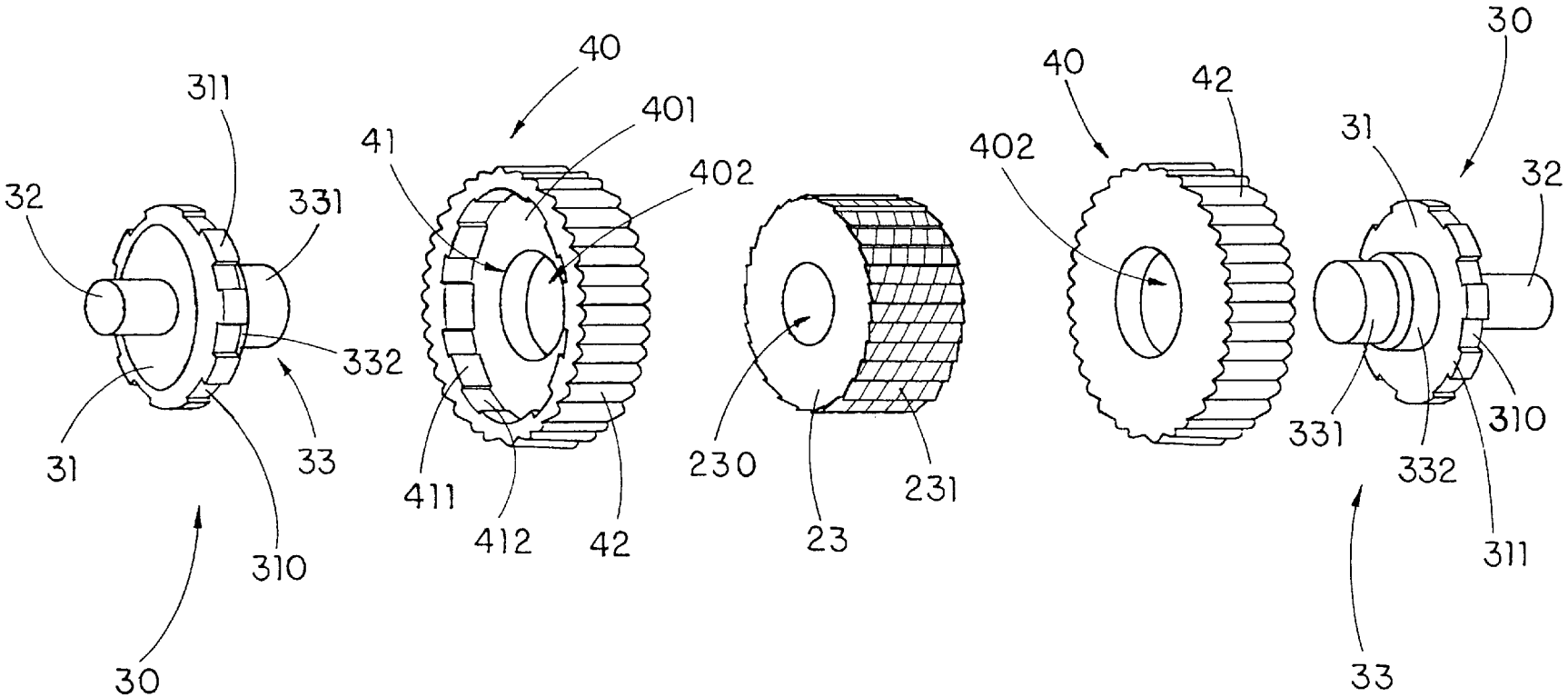
FIG. 3 is an exploded perspective view of the ignition means of the disposable childproof lighter according to the above preferred embodiment of the present invention.

As shown in FIGS. 2 and 3, the width of the each of the supporting gaps 24, i.e. the width of the support wheel 332, should be equal to or slight larger than the thickness of the side wall 401 of each driving cap 40. Accordingly, as shown in FIGS. 3 and 4, the two inner side walls 401 of the two driving caps 40 are rotatably disposed in the two supporting gaps 24 respectively so as to hold the two driving caps 40 in a rotatable position, wherein each of the driving cavities 41 has a plurality of driving teeth 411 are spacedly provided on an inner circumferential surface 412 of the respective driving cavities 41 in such a manner that the two driving caps 40 are normally disengaged with the two driven gear elements 30 to enable free rotation of the two driving caps 40 unless a downward force is intentionally applied on the driving caps 40 while rotating the driving caps 40 to drive the driven gear elements 30 and the striker wheel 23 to rotate to strike against the flint 21 to produce sparks.

Since the diameter of each of the driving cavities 41 is larger than the diameter of the respective gear wheel 31 received therein, the two driving caps 40 can be rotated to idle with respect to the two driven gear elements 30. In other words, the two driving caps 40 are normally disengaged with the driven gear elements 30 unless a relatively large force is applied to the two driving caps 40 by an adult to downwardly press the two driving caps 40 against the two gear wheels 31 of the two driven gear elements 30 in order to drive the driven gear elements 30 and the striker wheel 23 to rotate. Since a minor does not have enough power to press down and rotate the driving caps 40 at the same time, the arrangement of the two driven gear elements 30 and the two driving caps 40 can substantially prevent a minor from driving the striker wheel 23 to rotate and ignite the lighter.

Substantially, the driving teeth 411 provided on the inner circumferential surfaces 412 of the driving cavities 41 of the two driving caps 40 can be smaller teeth rendering the inner circumferential surfaces 412 to become coarse surfaces that can provide great friction when the two inner circumferential surface 412 are pressed against the driven gear teeth 311 provided on the outer circumferential surfaces of the two gear wheels 31. Alternatively, the driving teeth 411 of the two driving caps 40 can also be arranged to engage with a top portion of the driven gear teeth 311 of the gear wheels 31 of the two driven gear elements 30 when the two driving caps 40 are downwardly pressed down for ensuring the driven gear elements 30 to be driven to rotate by the driving caps 40 to drive the striker wheel 23 to strike against the flint 21 to generate sparks towards the gas valve 12.

Each of the driving caps 40 is not only rotatably mounted on the respective driven gear element 30, the inner side wall 401 of each driving cap 40 is also sandwiched between striker wheel 23 and the gear wheel 31 of the respective driven gear element 30. In other words, the driving caps 40 are rotatably held between the striker wheel 23 and the two driven gear elements 30 respectively that can prevent any unwanted axial loose of the driving cap 40 for ensuring effective engagement between the driving caps 40 and the driven gear elements 30 when the downward force is applied to the driving caps 40. In fact, during assemble, the two driving caps 40 must be coaxially aligned at two sides of the striker wheel 23 with the two driving cavities 41 thereof facing out, and then by plugging the two wheel axle 331 of the two support shank 33 of the two driven gear elements 30 into the two ends of the central axial hole 230 of the striker wheel 30 until the two gear wheels 31 of the two driven gear elements 30 are received in the two driving cavities 41 respectively.

Therefore, as shown in FIG. 2, the striker wheel 23, the two driving caps 40 and the two driven gear elements 30 are combined to form a single wheel unit with the two driving caps 40 being arranged free to rotate. The two driving caps 40 can not be detached from the wheel unit unless separating the two driven gear elements 30 from the striker wheel. Accordingly, the igniting means 20 is in a safety condition normally, wherein each of the driving caps 40 can be freely rotated around the gear wheel 31 and the support wheel 332 of the respective driven gear elements 30 respectively.

Figure 4A:
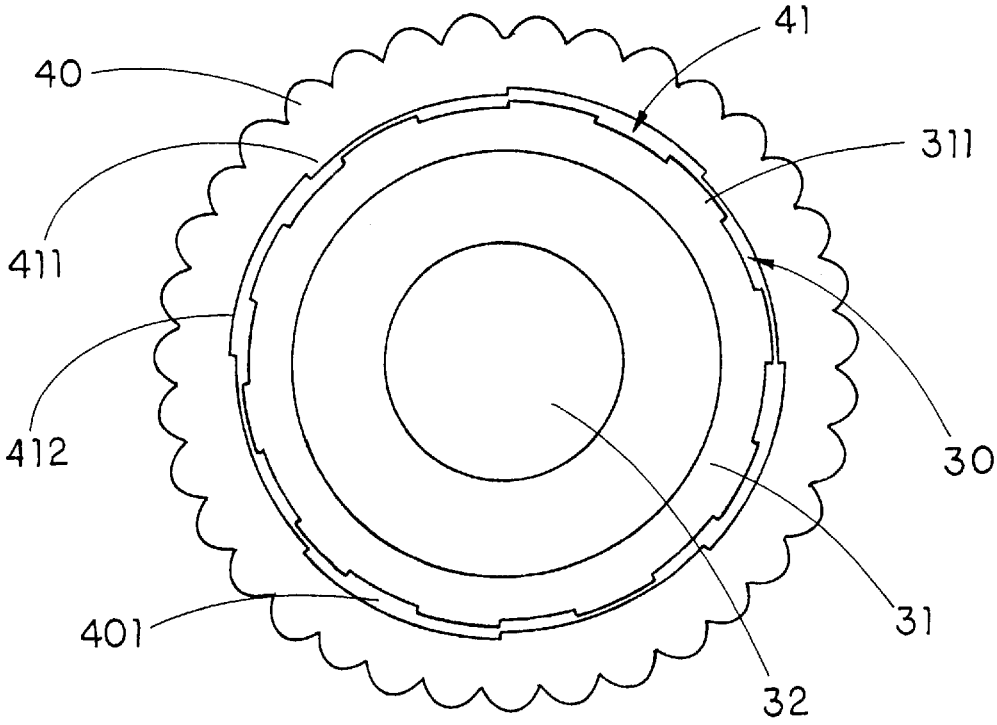
FIG. 4A is a sectional side view of the ignition means of the disposable childproof lighter according to the above preferred embodiment of the present invention.
Figure 4B:
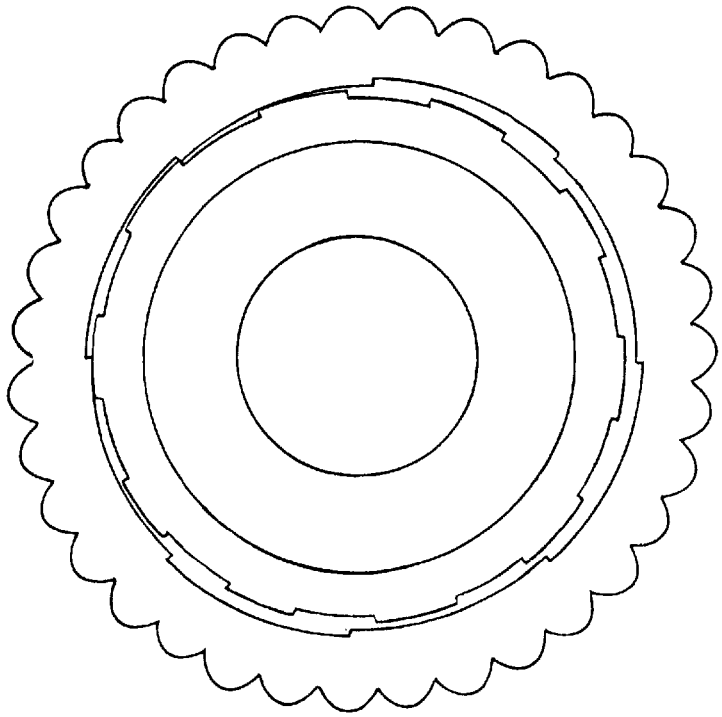
FIG. 4B is a sectional side view of the ignition means of the disposable childproof lighter according to the above preferred embodiment of the present invention, illustrating the engagement between the driven gear element and the driving cap.

Referring to FIG. 4A, the driven gear teeth 311 are spacedly and outwardly protruded from the outer circumferential surface of the gear wheel 31 of the each of the driven gear elements 30. Correspondingly, the driving teeth 411 of the driving caps 40 can also be arranged spacedly with respect to the driven gear teeth 311, so that when the driving caps 40 are pressed down by a downward force, one of the driving teeth 411 of each of the driving caps 40 will be pressed to engage with at least one of the upper driven gear teeth 311 of the respective gear wheels 31 for driving the driven gear elements 30 and the striker wheel 23 to rotate, as shown in FIG. 4B. In order to provide a better contact between the driving caps 40 and the adult's thumb, a knurling surface 42 is provided on an outer circumferential surface of each driving cap 40 such that the adult's thumb can easily drive the driving caps 40 to rotate.

Accordingly, children under five years old are not strong enough to press down the driving caps 40 to generate friction between the driving caps and the driven gear elements 30 or to maintain the engagement between the driving teeth 411 and the driven gear teeth 311 while turning the driving caps 40. However, an adult can easily "press and turn" the driving caps 40 to finish the ignition operation.

What is claimed is:

1. A disposable childproof lighter, comprising:

a supporting frame disposed on a gas reservoir having a valve which is actuated by a gas level pivotally mounted on said supporting frame for actuating said valve to release gas from said gas reservoir, wherein said supporting frame comprises a pair of supporting walls parallelly protruded upwardly at opposite sides of said gas level, each of said supporting walls having a supporting hole provided therein, and an ignition means, comprising:

a flint supported by a resilient element, a striker wheel, which is rotatably mounted on said supporting frame, having a plurality of striking teeth evenly provided on an outer circumferential surface thereof, wherein said flint is supported by said resilient element to upwardly urging against a portion of said striking teeth, a pair of driven gear elements for coaxially mounting said striker wheel between said two supporting walls of said supporting frame, each of said driven gear elements comprising a gear wheel having an outer circumferential surface and a support shank integrally and coaxially protruded from an inner side of said gear wheel, wherein said two support shanks, which are smaller than said two gear wheels in diameter, are coaxially mounted on two sides of said striker wheel to define two supporting gaps between said two sides of said striker wheel and said two gear wheels respectively, and said two gear wheels are respectively and rotatably mounted to said two supporting walls of said supporting frame in such a manner that said striker wheel is capable of being driven to rotate when driving said two gear wheels are driven to rotate, and a pair of driving caps, each having a circular driving cavity coaxially provided at an outer side thereof so as to define an inner side wall, each of said driving cavities having a diameter larger than that of said gear wheels of said driven gear elements, wherein a central support hole is coaxially provided at each of said inner side walls for rotatably mounting on said respective support shank of said respective driven gear element while said gear wheel of said respective driven gear element is rotatably received in said respective driving cavity, wherein said two inner side walls of said two driving caps are rotatably disposed in said two supporting gaps respectively so as to hold said two driving caps in a rotatable position between said striker wheel and said two driven gear elements respectively, wherein each of said driving cavities has an inner circumferential surface, wherein said two driving caps are arranged free to rotate normally with respect to said two driven gear elements unless a downward force is intentionally applied on said driving caps while rotating said driving caps to drive said driven gear elements and said striker wheel to rotate to strike against said flint to produce sparks.

2. The disposable childproof lighter, as recited in claim 1, wherein a plurality of driven gear teeth are spacedly provided on said outer circumferential surface of said gear wheel of each of said driven gear elements, and a plurality of driving teeth are spacedly provided on said inner circumferential surface of said driving cavity of each of said driving caps, so that said two driving caps are normally disengaged with said two driven gear elements to enable free rotation of said two driving caps unless said downward force is intentionally applied on said driving caps while rotating said driving caps.

3. The disposable childproof lighter, as recited in claim 2, wherein each of said support shanks comprises a wheel axle and a support wheel which is integrally and coaxially positioned between said gear wheel and said wheel axle, said two wheel axles, which are smaller than said two gear wheels in diameter, being coaxially fitted into two ends of a central axial hole of said striker wheel respectively, each of said two support wheels having a diameter larger than said two wheel axles, wherein when said two wheel axles are fully plugged into said two ends of said central axial hole of said striker wheel, said two supporting gaps are defined between said two sides of said striker wheel and said two gear wheels respectively, and that said inner side wall of each of said driving caps is sandwiched between said striker wheel and said gear wheel of said respective driven gear element.

4. The disposable childproof lighter, as recited in claim 3, wherein each of said driven gear elements further comprises a supporting shaft, in which said two supporting shafts are rotatably inserted into said supporting holes of said two supporting walls respectively.

5. The disposable childproof lighter, as recited in claim 4, wherein said driven gear teeth are spacedly and outwardly protruded from said outer circumferential surface of said gear wheel of said each of said driven gear elements, and said driving teeth of said when said driving caps are pressed down by a downward force, one of said driving teeth of each of said driving caps is pressed to engage with at least one of said upper driven gear teeth of said respective gear wheels for driving said driven gear elements and said striker wheel to rotate.

6. A disposable childproof lighter, as recited in claim 5, wherein a knurling surface is provided on an outer circumferential surface of each driving cap.

7. A disposable childproof lighter, as recited in claim 4, wherein a knurling surface is provided on an outer circumferential surface of each driving cap.

8. The disposable childproof lighter, as recited in claim 3, wherein said driven gear teeth are spacedly and outwardly protruded from said outer circumferential surface of said gear wheel of said each of said driven gear elements, and said driving teeth of said when said driving caps are pressed down by a downward force, one of said driving teeth of each of said driving caps is pressed to engage with at least one of said upper driven gear teeth of said respective gear wheels for driving said driven gear elements and said striker wheel to rotate.

9. A disposable childproof lighter, as recited in claim 8, wherein a knurling surface is provided on an outer circumferential surface of each driving cap.

10. A disposable childproof lighter, as recited in claim 3, wherein a knurling surface is provided on an outer circumferential surface of each driving cap.

11. The disposable childproof lighter, as recited in claim 2, wherein said driven gear teeth are spacedly and outwardly protruded from said outer circumferential surface of said gear wheel of said each of said driven gear elements, and said driving teeth of said when said driving caps are pressed down by a downward force, one of said driving teeth of each of said driving caps is pressed to engage with at least one of said upper driven gear teeth of said respective gear wheels for driving said driven gear elements and said striker wheel to rotate.

12. A disposable childproof lighter, as recited in claim 11, wherein a knurling surface is provided on an outer circumferential surface of each driving cap.

13. A disposable childproof lighter, as recited in claim 2, wherein a knurling surface is provided on an outer circumferential surface of each driving cap.

14. The disposable childproof lighter, as recited in claim 1, wherein each of said support shanks comprises a wheel axle and a support wheel which is integrally and coaxially positioned between said gear wheel and said wheel axle, said two wheel axles, which are smaller than said two gear wheels in diameter, being coaxially fitted into two ends of a central axial hole of said striker wheel respectively, each of said two support wheels having a diameter larger than said two wheel axles, wherein when said two wheel axles are fully plugged into said two ends of said central axial hole of said striker wheel, said two supporting gaps are defined between said two sides of said striker wheel and said two gear wheels respectively, and that said inner side wall of each of said driving caps is sandwiched between said striker wheel and said gear wheel of said respective driven gear element.

15. The disposable childproof lighter, as recited in claim 14, wherein each of said driven gear elements further comprises a supporting shaft, in which said two supporting shafts are rotatably inserted into said supporting holes of said two supporting walls respectively.

16. A disposable childproof lighter, as recited in claim 15, wherein a knurling surface is provided on an outer circumferential surface of each driving cap.

17. A disposable childproof lighter, as recited in claim 14, wherein a knurling surface is provided on an outer circumferential surface of each driving cap.

18. The disposable childproof lighter, as recited in claim 1, wherein a knurling surface is provided on an outer circumferential surface of each driving cap.

* * * * *